US006098976A

United States Patent [19]

Gieser et al.

[11] Patent Number: 6,098,976

[45] Date of Patent: Aug. 8, 2000

[54] DEVICE FOR UNROLLING SHEETS

[75] Inventors: Michael Gieser, Oftersheim; Edmund Klein, Wilhelmsfeld, both of Germany

[73] Assignee: Heidelberger Druckmaschinen Aktiengesellschaft, Heidelberg, Germany

[21] Appl. No.: 09/272,076

[22] Filed: Mar. 18, 1999

[30] Foreign Application Priority Data

Mar. 18, 1998 [DE] Germany ..... 198 11 643

[51] Int. Cl.[7] ..... B65H 23/24; B65H 23/34; B65H 29/04; B65H 29/70

[52] U.S. Cl. ..... 271/183; 271/204; 226/195

[58] Field of Search ..... 271/183, 204; 242/419.3; 226/195; 72/54, 160; 162/197, 270, 271

[56] References Cited

U.S. PATENT DOCUMENTS 4,002,047 1/1977 MacPhee et al. ..... 271/183
4,013,284 3/1977 Demetre ..... 271/183
4,119,309 10/1978 Mayer et al. ..... 271/183

FOREIGN PATENT DOCUMENTS

2838586C2 6/1985 Germany .
3928992A1 3/1990 Germany .

*Primary Examiner*—John M. Jillions
*Attorney, Agent, or Firm*—Herbert L. Lerner; Laurence A. Greenberg; Werner H. Stemer

[57] ABSTRACT

A device for unrolling sheets, with positively guided leading edges, travelling along a conveying path of a delivery of a printing machine for processing the sheets, the sheet unrolling device being formed with a first unrolling groove followed upline in the conveying direction by at least one second unrolling groove, and having a negative-pressure generator for subjecting a respective unrolling groove to negative pressure, includes a delaying device for delaying a negative-pressure increase in the second unrolling groove relative to a negative-pressure increase in the first unrolling groove; and a delivery of a printing machine combined with the sheet-unrolling device.

4 Claims, 4 Drawing Sheets

DEVICE FOR UNROLLING SHEETS

BACKGROUND OF THE INVENTION

Field of the Invention

The invention relates to a device for unrolling sheets, having positively guided leading edges, along a conveying path of a delivery of a printing machine for processing the sheets, the sheet unrolling device being formed with a first unrolling groove followed upline in the conveying direction by at least one second unrolling groove, and having a negative-pressure generator for subjecting a respective unrolling groove to negative pressure. The invention also relates to a delivery of a sheet-processing printing machine provided with the sheet-unrolling device.

A sheet-unrolling device of the general type referred to in the introduction hereto has become known heretofore, for example, from the published German Patent Document DE 39 28 992 A1. In this regard, successive unrolling grooves are formed by interstices which are produced between tubes joined laterally to one another or between a tube and a metal plate joined to the lateral surface of the tube and, in an end section that is positioned on the tube, is curved so that it forms somewhat of a counterpart to the lateral surface of the tube. The tube or tubes are formed as suction tubes and, for this purpose, provided with suction openings terminating in the respective interstices.

During the proposed use of this sheet-unrolling device in the delivery of a sheet-processing printing machine, sheets sweep over the device, with positive guidance of a respective leading edge of the sheets being afforded by a revolving gripper system. In order to ensure the so-called springing of a sheet directly into an unrolling groove, i.e. sucking of a sheet directly into the groove under the action of negative pressure prevailing therein, the sheet must be guided over the unrolling groove at the smallest possible spaced distance therefrom. If this condition is fulfilled, and if sufficient negative pressure prevails in the unrolling grooves, then, in the case of the heretofore known sheet-unrolling device, a respective sheet is sucked into that unrolling groove which the sheet reaches first. In this regard, that region of the sheet which leaves the unrolling groove is subjected to a tensile force which is exerted on the sheet by the positive guidance of the leading edge and results from the frictional force between the sheet-unrolling device and the sheet. This tensile force tautens that region of the sheet which leaves the unrolling groove, and counteracts the action of the sheet being sucked into a further, downline unrolling groove. This adverse effect cannot be overcome even, in the case of the heretofore known sheet-unrolling device, by the presence of a relatively high negative pressure in the downline unrolling groove because the frictional force occurring in the upline unrolling groove and, thus, the aforementioned tensile force acting upon the sheet, would thereby increase.

SUMMARY OF THE INVENTION

It is accordingly an object of the invention to provide an improved sheet-unrolling device of the general type mentioned in the introduction hereto by which a sheet passing over the sheet-unrolling device, with positive guidance in a region of the leading edge thereof, is sucked into each of the unrolling grooves.

With the foregoing and other objects in view, there is provided, in accordance with the invention, a device for unrolling sheets, with positively guided leading edges, travelling along a conveying path of a delivery of a printing machine for processing the sheets, the sheet unrolling device being formed with a first unrolling groove followed upline in the conveying direction by at least one second unrolling groove, and having a negative-pressure generator for subjecting a respective unrolling groove to negative pressure, comprising a delaying device for delaying a negative-pressure increase in the second unrolling groove relative to a negative-pressure increase in the first unrolling groove.

In accordance with another feature of the invention, the delaying device comprises a valve for periodically interrupting a connection between the second unrolling groove and the negative-pressure generator.

In accordance with a further feature of the invention, the delaying device is formed by a throttle providing a connection between the second unrolling groove and the first unrolling groove.

In accordance with a concomitant feature of the invention, there is provided a delivery for a printing machine processing sheets, comprising, in combination, a configuration of the sheet-unrolling device according to the invention.

A respective sheet is thus sucked initially into the unrolling groove located farthest downline, as viewed in the sheet-conveying direction, and then into the unrolling groove following upline.

When there are more than two unrolling grooves following one another in the conveying direction, the delaying device provided in accordance with the invention has the effect of causing the respective sheets to be sucked in gradually, this gradual sucking action beginning at the unrolling groove farthest downline, and continuing successively at the respective unrolling grooves following upline. Assurance is thereby offered relatively easily that each of the unrolling grooves also actually provides an unrolling action.

Other features which are considered as characteristic for the invention are set forth in the appended claims.

Although the invention is illustrated and described herein as embodied in a device for unrolling sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
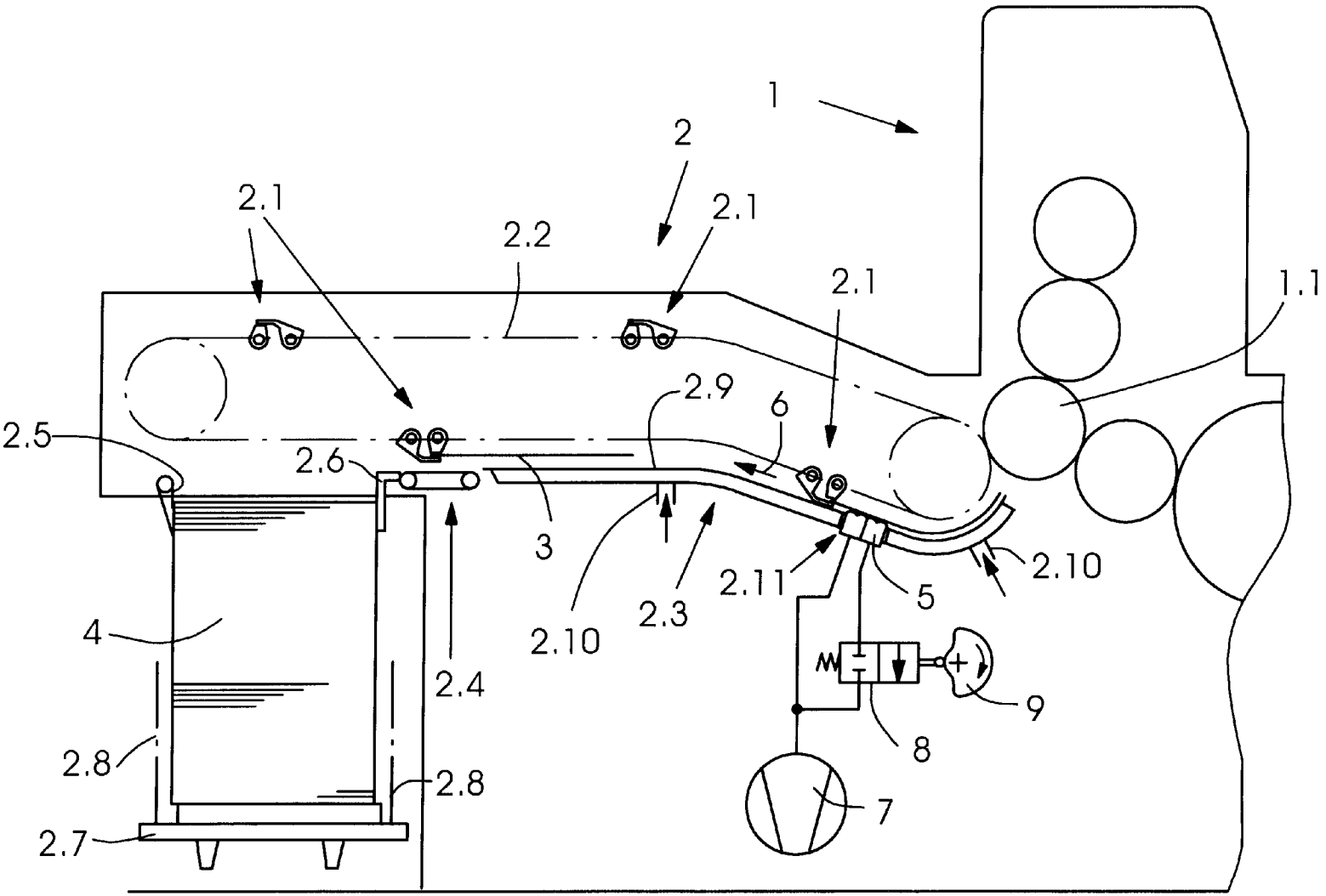
FIG. 1 is a fragmentary diagrammatic and schematic view of a sheet-processing printing machine provided with the sheet-unrolling device according to the invention, the printing machine including a delivery arrangement, and the exemplary embodiment of the sheet-unrolling device having a delaying device in the form of a valve.

Referring now to the drawings and, first, particularly, to FIG. 1 thereof, there is shown therein a sheet-unrolling device according to the invention which forms a constituent part of a delivery 2 following a last processing station 1 of a printing machine. The last processing station 1 may be a printing unit or a finishing unit, such as a coating unit, for example. In the exemplary embodiment of FIG. 1, the processing station 1 is an offset printing unit. The adjoining delivery 2 includes gripper systems 2.1 which are borne by a chain conveyor 2.2 revolving during operation and represented herein in phantom or by dot-dash lines. During one revolution of a respective gripper system 2.1, it accepts a sheet 3 from an impression cylinder 1.1 conducting the sheet 3, and transports it, via a sheet-guiding device 2.3, to a sheet brake 2.4. The latter accepts the sheet 3, that is released by the gripper system 2.1, slows it down to a deposition speed and finally releases it, with the result that the sheet 3, moving at the deposition speed and being lowered at the same time, comes into contact with leading-edge stops 2.5 and, being aligned against the latter and against trailing-edge stops 2.6, which are located opposite the leading-edge stops 2.5, forms a sheet pile 4 together with preceding and/or following sheets 3, the sheet pile 4 being carried by a lifting mechanism which lowers the sheet pile 4 to the same extent as the height thereof increases. The lifting mechanism is represented in FIG. 1 only by a platform 2.7 thereof, that bears the sheet pile 4, and lifting chains 2.8, which bear the platform 2.7 and are represented in phantom or by dot-dash lines.

The sheet-guiding device 2.3 has a sheet-guiding surface 2.9 formed thereon which follows the path of the gripper systems 2.1 guided thereover and, preferably for the purpose of guiding sheets which are printed on both sides, is provided with nozzles (not illustrated in FIG. 1) for producing an air cushion between the sheet-guiding surface 2.9 and the sheets 3 directed or guided thereover, the nozzles being fed by an air-supply system represented in FIG. 1 by connecting stubs 2.10.

In the case wherein the device for unrolling sheets is used, a smoothing device 5 is inserted into a closable gap 2.11 formed in the sheet-guiding surface 2.9 of the sheet-guiding device 2.3, that preferably extends substantially continuously for the purpose of guiding sheets which are printed on both sides thereof.

Figure 2:
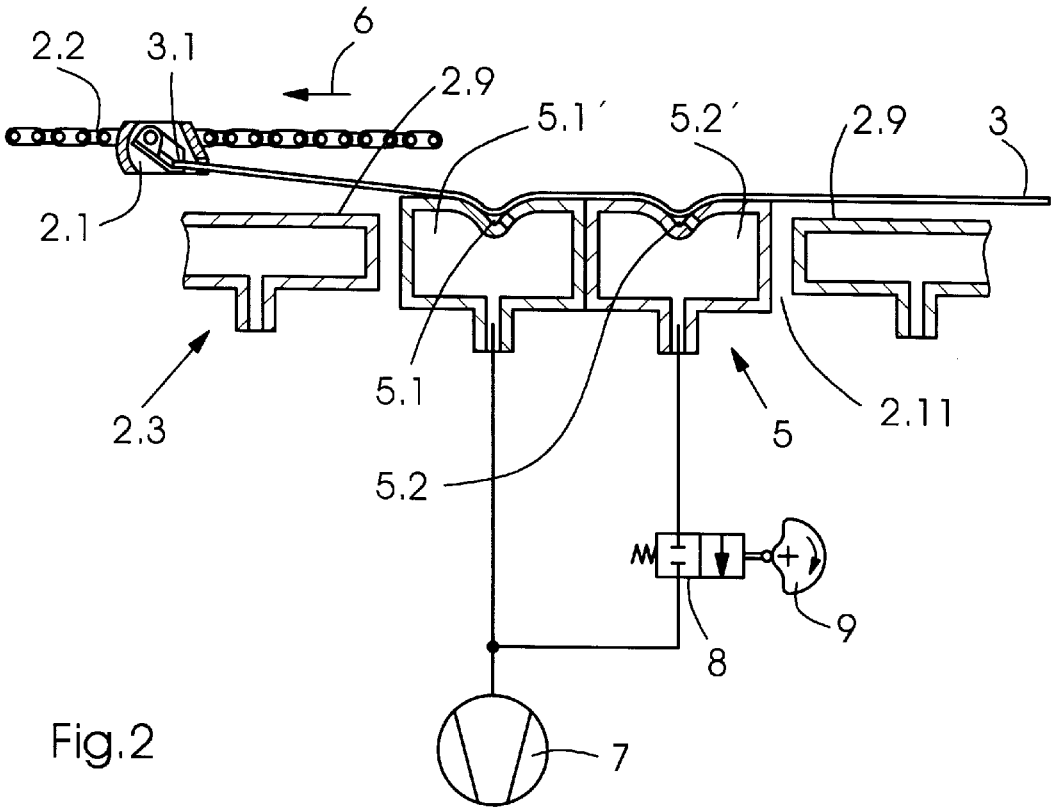
FIG. 2 is an enlarged fragmentary view of FIG. 1 showing the exemplary sheet-unrolling device in greater detail.

As is apparent from FIG. 2, a first unrolling groove 5.1 is provided on the smoothing device 5 and, in this exemplary embodiment, just one further or second unrolling groove 5.2, is located upline from the first unrolling groove 5.1 as seen in the sheet-conveying direction. The unrolling grooves 5.1 and 5.2 extend transversely to the sheet conveying direction represented by the horizontal arrow 6 and, at both ends thereof, the grooves 5.1 and 5.2 extend beyond the dimensions of the sheets 3 which are transverse to the conveying direction.

A respective sheet 3 guided by the impression cylinder 1.1 is gripped by a gripper system 2.1, in a gripper border region thereof that adjoins a leading edge 3.1 of the respective sheet 3, as viewed in the sheet-conveying direction represented by the arrow 6 and, thus, with positive guidance of the leading edge 3.1, runs or travels along a conveying path through the delivery 2, at the end of which, transfer of the sheet 3 to the sheet brake 2.4 occurs.

In one section of this conveying path, the respective sheet 3 passes the first unrolling groove 5.1 and, in the embodiment of FIG. 2, just one second unrolling groove 5.2, is located upline, as viewed in the conveying direction.

The unrolling grooves 5.1 and 5.2 communicate with respective negative-pressure chambers 5.1' and 5.2' and, via the latter, are subjectible to negative pressure from a negative-pressure generator 7. The downlime first unrolling groove 5.1 is continually connected to the negative-pressure generator 7, so that, in this unrolling groove 5.1, an increase in negative pressure to a maximum value occurs when the groove is covered by the sheet 3. A corresponding increase in negative pressure in the second unrolling groove 5.2 occurs with a time delay relative to that in the first unrolling groove 5.1.

In the exemplary embodiment according to FIGS. 1 and 2, a delaying device in the form of a mechanically controlled valve 8 is provided for this purpose. The valve 8 is constructed as a two-position/two-way valve and is inserted into a line via which, with the valve 8 in an appropriate position, the second unrolling groove 5.2 can be subjected to negative pressure from the negative-pressure generator 7. In the position of the valve 8 illustrated in FIGS. 1 and 2, the connection of the second unrolling groove 5.2 to the negative-pressure generator 7 has been interrupted. By the use of a cam 9 that controls the valve 8 and, during operation, rotates at the rotational speed of the impression cylinder 1.1 in this exemplary embodiment, the valve position is always set at the latest when a respective sheet 3 has left the smoothing device 5, and this position is maintained until a succeeding sheet 3 covers the first unrolling groove 5.1 and, due to the thereby resulting negative-pressure increase to a maximum value therein, is sucked into the first unrolling groove 5.1. In the instant exemplary embodiment, the cam 9 thus ensures a periodic interruption in a connection between the second unrolling groove 5.2 and the negative-pressure generator 7. After the sheet 3 has been sucked into the first unrolling groove 5.1, the cam 9 thus shifts the valve 8 into the second position thereof, wherein a connection between the second unrolling groove 5.2 and the negative-pressure generator 7 is then produced. The second unrolling groove 5.2 is thereby covered by the sheet that has already been sucked in by the first unrolling groove 5.1, so that there is then also a negative-pressure increase to a maximum value in the second unrolling groove 5.2, and the sheet 3 is also sucked into the second unrolling groove 5.2.

Figure 3:
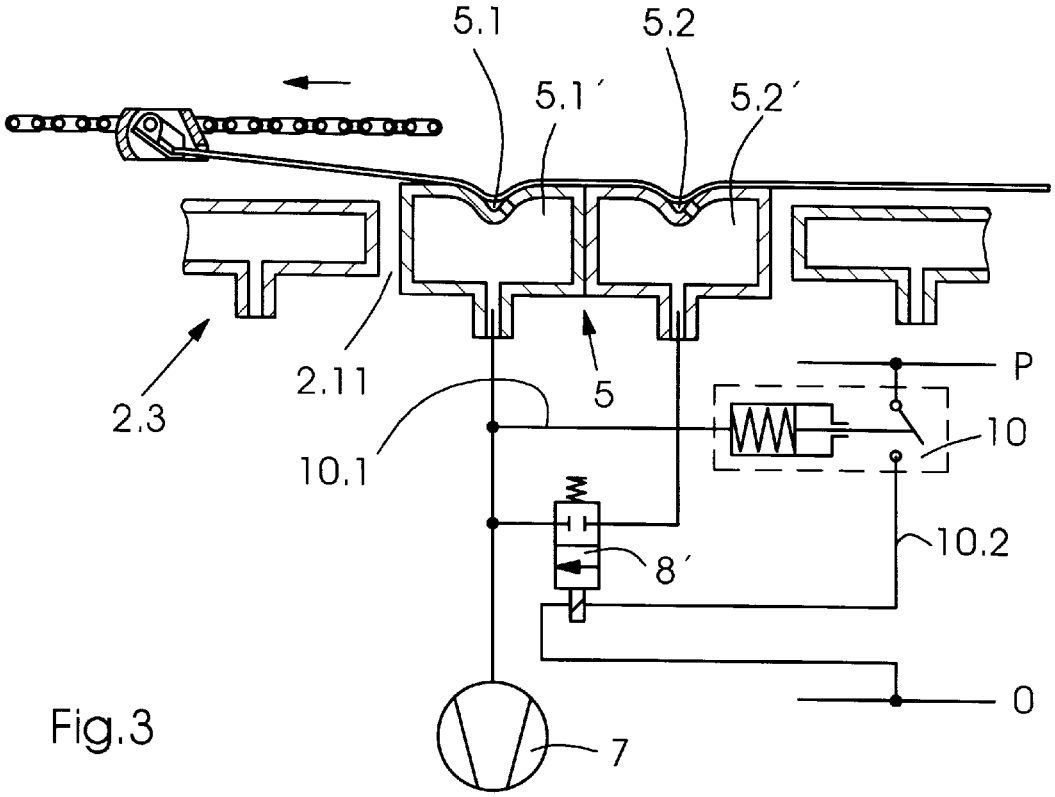
FIGS. 3 to 6 are views like that of FIG. 2, showing further exemplary embodiments of the sheet-unrolling device with the delaying device thereof formed as a valve.

In an exemplary embodiment illustrated in FIG. 3, the delaying device is likewise in the form of a two-way/two-position valve 8', that is arranged analogously to the exemplary embodiment according to FIG. 2, but is activatable electromagnetically. Provided for this purpose is a vacuum switch 10 with a vacuum line 10.1 communicating with the first unrolling groove 5.1. The vacuum switch 10 is formed as a make contact and closes a circuit 10.2 that activates the valve 8' when, after a sheet 3 has been sucked into the first unrolling groove 5.1, a given negative-pressure increase has occurred in that groove 5.1. Following the closure of the circuit 10.2, the valve 8' resumes the position wherein the second unrolling groove 5.2 communicates with the negative-pressure generator 7, so that, with a time delay relative to the negative-pressure increase in the first unrolling groove 5.1, there is then a negative-pressure increase in the second unrolling groove 5.2, due to which the sheet 3 is sucked into the latter.

With such a configuration of the delaying device, the latter fulfills the intended purpose thereof automatically, with automatic periodic interruption of a connection between the second unrolling groove 5.2 and the negative-pressure generator 7 through the intermediary of a valve. This also applies to the configurations formed as valves which are described hereinafter wherein, as with the exemplary embodiment according to FIG. 3, the periodic interruption is initiated by a periodic release by the first unrolling groove 5.1 of a respective sheet.

Figure 4:
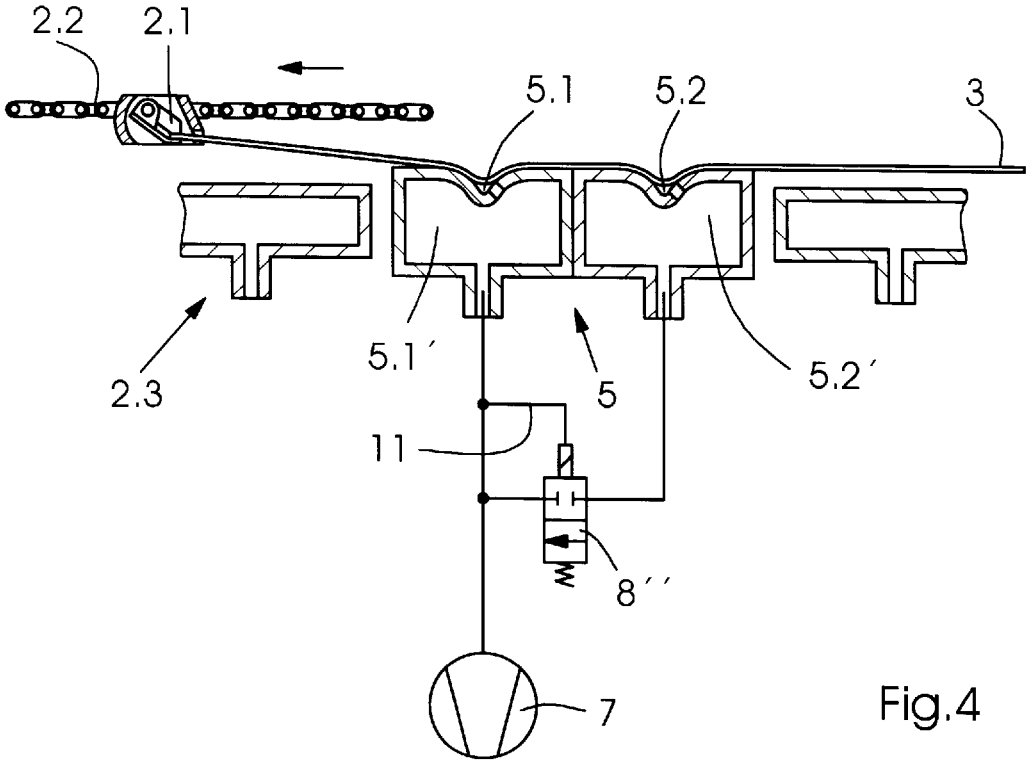

In an exemplary embodiment illustrated in FIG. 4, the delaying device is likewise formed by a two-way/two-position valve 8", that is arranged, analogously to the exemplary embodiment according to FIG. 2. This valve 8", however, is activatable pneumatically, so that a negative pressure can change it over from a normally closed position into an open position. For this purpose, the valve 8" is connected to the first unrolling groove 5.1 via a pneumatic control line, so that, in the event of a negative-pressure increase in the groove 5.1 as the latter is covered by a sheet 3 guided thereover, the valve 8" assumes the open position thereof and produces the connection between the negative-pressure generator 7 and the second unrolling groove 5.2 with a time delay relative to the negative-pressure increase in the first unrolling groove 5.1.

Figure 5:
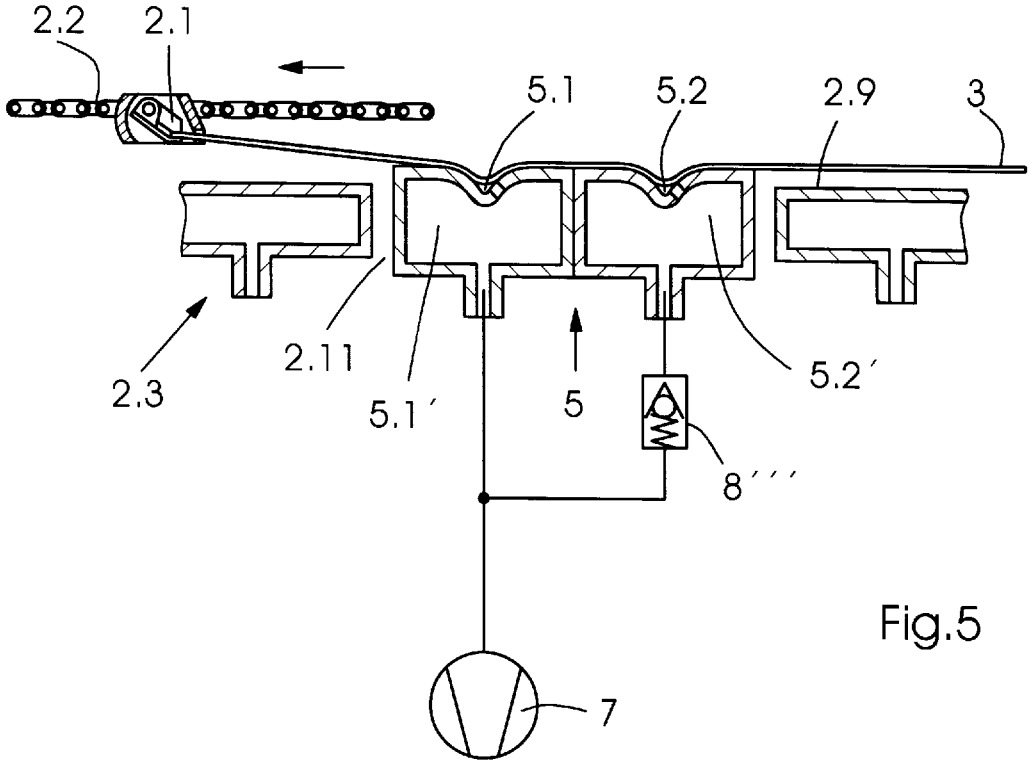

Instead of two-way/two-position valve, the exemplary embodiment illustrated in FIG. 5 uses a straightforward valve 8'" formed as a check valve that is inserted into a line connecting the second unrolling groove 5.2 to the line producing the continual connection between the first unrolling groove 5.1 and the negative-pressure generator 7. In this regard, the valve 8'" formed as a check valve is installed so that it opens when a negative-pressure increase has taken place, in the manner described hereinbefore, in the line connecting the first unrolling groove 5.1 to the negative-pressure generator 7. In this operating state, the sheet 3 has already been sucked into the first unrolling groove 5.1 and, with a time delay, th e sheet 3 is then additionally sucked into the second unrolling groove 5.2.

Figure 6:
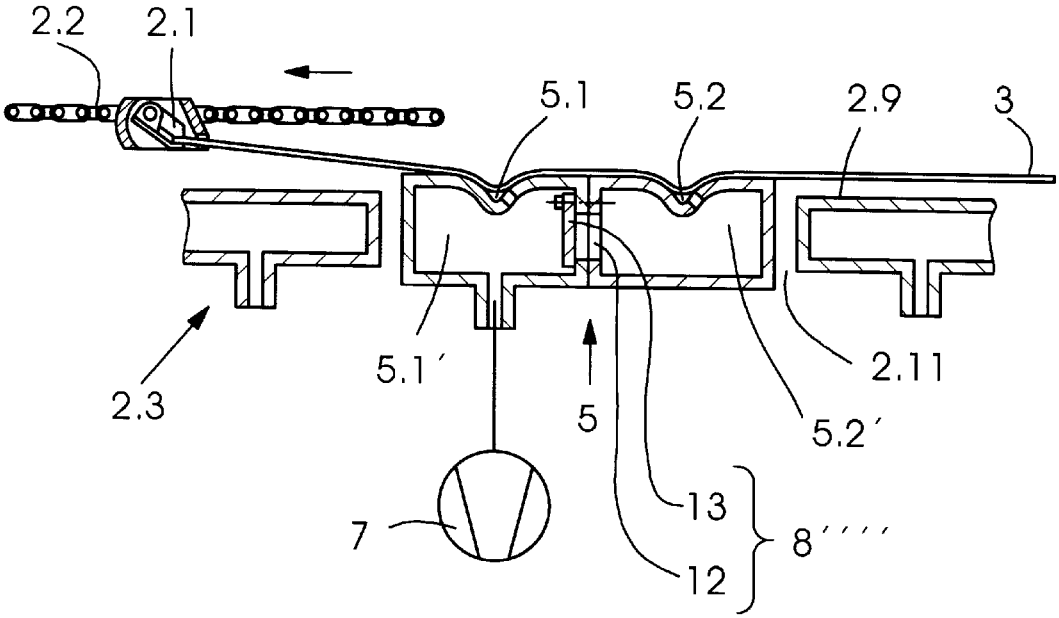

The exemplary embodiment illustrated in FIG. 6 once again uses a valve 8"" formed as a check valve. While the valve in the exemplary embodiment according to FIG. 5 is a ball check valve, the valve 8"" is constructed, in the exemplary embodiment according to FIG. 5, as a flutter valve. Provided for this purpose is an opening 12 connecting the two negative-pressure chambers 5.1' and 5.2' and covered by an elastic sealing plate 13 in the negative-pressure chamber 5.1', that is in constant connection with the negative-pressure generator 7 and is assigned to the first unrolling groove 5.1. The sealing plate 13 is fastened just at one location on a wall of the negative-pressure chamber 5.1', the wall being formed with the opening 12, and the elasticity of the sealing plate is selected so that, in the event of a drop in pressure of a specific value, between the two negative-pressure chambers 5.1' and 5.2', in the direction of the negative-pressure chamber 5.1', the sealing plate is lifted away from the opening 12 into the interior of the negative-pressure chamber 5.1'. If this drop in pressure is achieved as a result of a negative-pressure increase in the negative-pressure chamber 5.1' due to the sheet 3 being sucked into the first unrolling groove 5.1, then the sealing plate 13, lifted away from the opening 12 in the process, permits a delayed negative-pressure increase in the negative-pressure chamber 5.2' and thus allows the sheet 3 to be sucked into the second unrolling groove 5.2.

Figure 7:
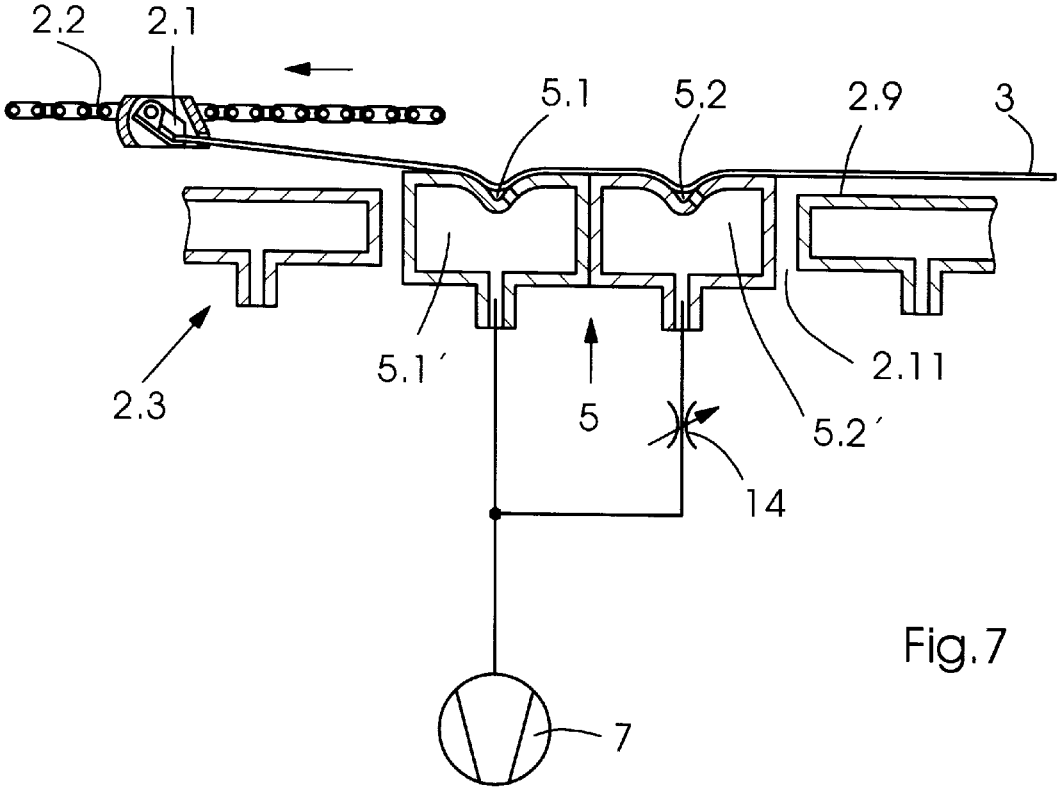
FIG. 7 is yet another view like those of FIGS. 2 to 6 of an additional exemplary embodiment of the sheet-unrolling device which, however, has a delaying device in the form of a throttle.

In the case of the configuration according to FIG. 7, the delaying device is formed by a throttle 14, that is inserted into a line connecting the second unrolling groove 5.2 to that line producing the constant connection between the first unrolling groove 5.1 and the negative-pressure generator 7. The throttle 14 can preferably be set and is formed so that a negative-pressure increase produced in the first unrolling groove 5.1 due to the sheet 3 being sucked into the latter groove 5.1 produces a negative-pressure increase in the second unrolling groove 5.2 that is sufficient for sucking the sheet 3 into the second unrolling groove 5.2.

The diagrammatic and schematic illustrations, which contain symbols used in pneumatics, are not to be understood as design specifications. This applies, amongst others, in particular with regard to the configuration and the arrangement of the vacuum switch 10, the valve 8'" formed as a check valve, and the throttle 14. Also, the smoothing device 5 is only diagrammatically and schematically illustrated and, in spite of the fact that, as is usual in pneumatics, the valves 8, 8', 8", 8'" and 8"" are illustrated in the non-activated, in this case, closed state thereof, the sheet 3 guided over the smoothing device 5 is illustrated as having been sucked into the two unrolling grooves 5.1 and 5.2.

We claim:

1. A device for unrolling sheets, with positively guided leading edges, travelling along a conveying path of a delivery of a printing machine for processing the sheets, the sheet unrolling device being formed with a first unrolling groove followed upline in the conveying direction by at least one second unrolling groove, and having a negative-pressure generator for subjecting a respective unrolling groove to negative pressure, comprising a delaying device for delaying a negative-pressure increase in the second unrolling groove relative to a negative-pressure increase in the first unrolling groove.

2. The sheet-unrolling device according to claim 1, wherein said delaying device comprises a valve for periodically interrupting a connection between the second unrolling groove and the negative-pressure generator.

3. The sheet-unrolling device according to claim 1, wherein said delaying device is formed by a throttle providing a connection between the second unrolling groove and the first unrolling groove.

4. A delivery for a printing machine processing sheets, comprising, in combination, a configuration of the sheet-unrolling device according to claim 1.

* * * * *